US007231784B2

(12) United States Patent
Howard et al.

(10) Patent No.: US 7,231,784 B2
(45) Date of Patent: Jun. 19, 2007

(54) METHOD FOR PRODUCING LIQUEFIED NATURAL GAS

(75) Inventors: Henry Edward Howard, Grand Island, NY (US); Minish Mahendra Shah, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 309 days.

(21) Appl. No.: 10/962,666

(22) Filed: Oct. 13, 2004

(65) Prior Publication Data

US 2006/0075777 A1 Apr. 13, 2006

(51) Int. Cl.
*F25J 1/00* (2006.01)
*F25J 3/00* (2006.01)

(52) U.S. Cl. ..... 62/613; 62/626

(58) Field of Classification Search ..... 62/613, 62/626

See application file for complete search history.

(56) References Cited

U.S. PATENT DOCUMENTS 3,182,461 A * 5/1965 Johanson ..... 62/619
3,360,944 A 1/1968 Knapp et al. ..... 62/12
3,503,220 A * 3/1970 Desai ..... 62/613
3,894,856 A * 7/1975 Lofredo et al. ..... 95/115
4,012,212 A 3/1977 Kniel ..... 62/26
4,229,195 A * 10/1980 Forg ..... 62/612
4,421,535 A * 12/1983 Mehra ..... 62/625
4,522,636 A 6/1985 Markbreiter et al. ..... 55/23
5,486,227 A * 1/1996 Kumar et al. ..... 95/41
6,131,407 A * 10/2000 Wissolik ..... 62/606
6,694,774 B1 2/2004 Rashad et al. ..... 62/612

* cited by examiner

*Primary Examiner*—William C. Doerrler
(74) *Attorney, Agent, or Firm*—Donald T. Black

(57) ABSTRACT

A method for producing liquefied natural gas employing two separate adsorption steps for removing water and carbon dioxide from natural gas and employing a subambient expansion to produce regeneration gas for the regeneration of the dehydration adsorption step in addition to supplying refrigeration for the cooling or liquefaction of clean natural gas.

11 Claims, 1 Drawing Sheet

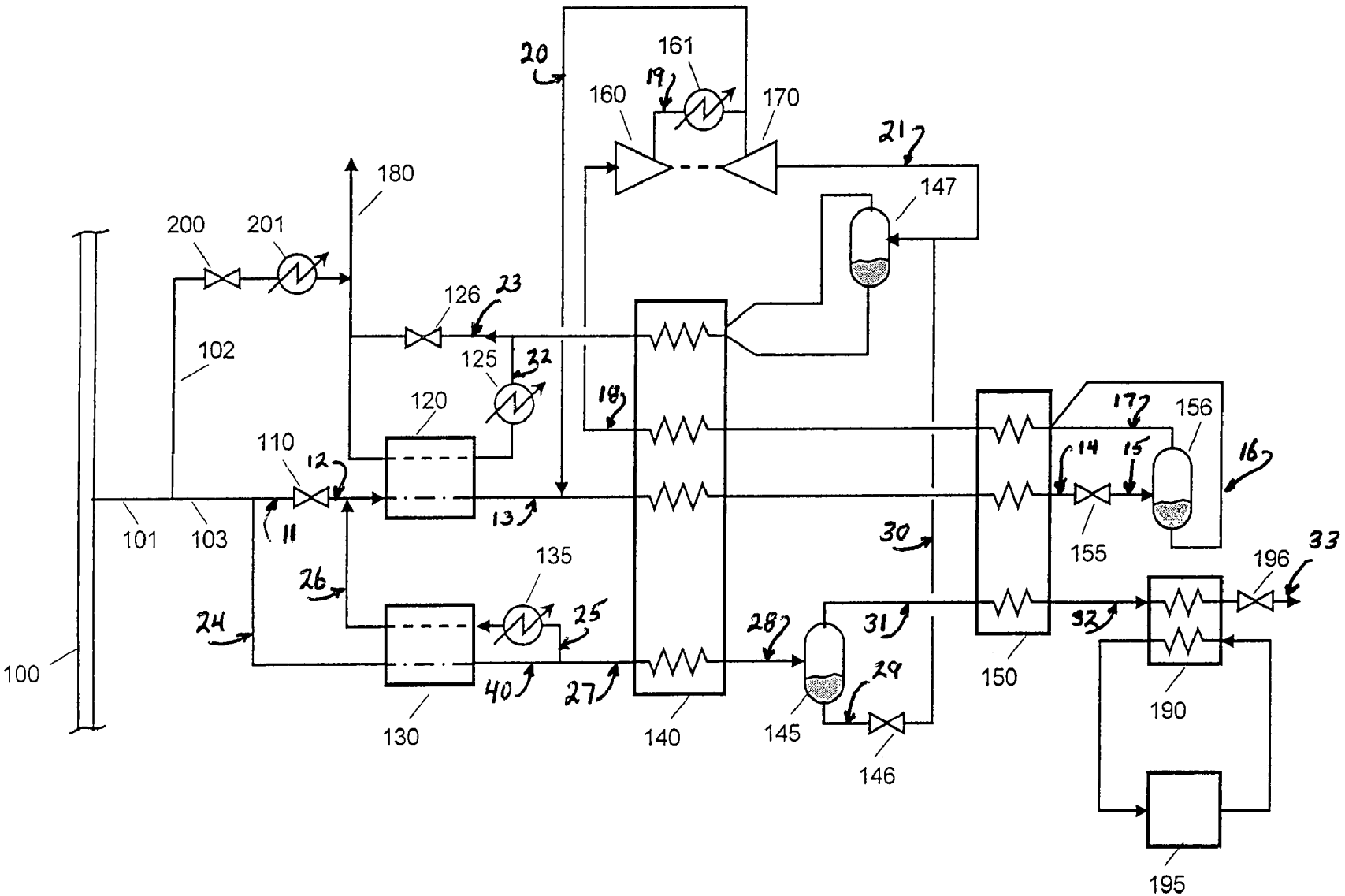
100
101
102
103
110
11
12
13
14
15
16
17
18
19
20
21
22
23
24
25
26
27
28
29
30
31
32
33
40
120
125
126
130
135
140
145
146
147
150
155
156
160
161
170
180
190
195
196
200
201

METHOD FOR PRODUCING LIQUEFIED NATURAL GAS

TECHNICAL FIELD

This invention relates generally to the production of liquefied natural gas and, more particularly, to the production of liquefied natural gas using cryogenic expansion and the pretreatment of the natural gas for use in such a process.

BACKGROUND ART

Typically natural gas transmission pipelines operate at pressures ranging between 700 and 1500 psia. Natural gas pressure reduction points are often referred to as let-down stations. Such stations enable the regional distribution of natural gas (typically at pressures of 150 to 500 psia). In general, let-down stations are not designed for the useful recovery of the pressure energy. Processes which serve to let-down natural gas while producing a fraction of the inlet gas as liquefied natural gas are often referred to as expander cycles or expander plants.

Typically, natural gas is transmitted with residual amounts of water 5–10 lbs-$H_2O$/MMscfd and about 2.0 mole % carbon dioxide or more. In order to operate a cryogenic process (such as an expander plant) producing liquefied natural gas from a pipeline gas, it is necessary to remove both the water and the carbon dioxide to very low levels (<1 and <50 ppm, respectively). The removal of high boiling contaminants (water, carbon dioxide, hydrogen sulfide) is often referred to as pre-purification or pre-treatment. Adsorption systems are often used for the removal of water, carbon dioxide and hydrogen sulfide from pipeline gas streams. The regeneration of adsorption systems requires that a cleaned (contaminant free) stream be passed over the loaded bed in order to remove the high-boiling contaminants. Typically, regeneration gas for these systems is derived from the compression of low-pressure flash gas. This flash gas is generated upon the depressurization of highly subcooled supercritical pressure natural gas. Such an approach results in poor liquefaction efficiency and low liquefied natural gas yield (typically <10% of the feed is liquefied).

Accordingly it is an object of this invention to provide an improved method for producing liquefied natural gas using subambient expansion.

SUMMARY OF THE INVENTION

The above and other objects, which will become apparent to those skilled in the art upon a reading of this disclosure, are attained by the present invention which is:

A method for producing liquefied natural gas comprising:

(A) removing water from a first natural gas stream in a first adsorption unit to produce dehydrated natural gas, cooling the dehydrated natural gas to a temperature below the critical temperature of methane to produce cooled dehydrated natural gas, expanding the cooled dehydrated natural gas in a subambient expansion to produce depressurized natural gas, warming the depressurized natural gas, and using a portion of the warmed depressurized natural gas as regeneration gas in the first adsorption unit; and (B) removing carbon dioxide and water from a second natural gas stream in a second adsorption unit to produce clean natural gas, liquefying a portion of the clean natural gas to produce liquefied natural gas, and using another portion of the clean natural gas as regeneration gas in the second temperature swing adsorption unit.

As used herein the term "adsorption unit" means a system incorporating at least one vessel, preferably two or more, containing a solid adsorbent such as silicon dioxide or molecular sieves, which preferentially adsorbs at least one constituent from a feed gas. The adsorption unit also comprises necessary valving to direct both feed and regeneration gases through the bed(s) at varying time intervals.

As used herein the term "regeneration gas" means a fluid that contains substantially less adsorbing contaminant than the feed stream to an adsorption unit.

As used herein the term "Joule-Thomson valve expansion" means expansion employing an isenthalpic pressure reduction device which typically may be a throttle valve, orifice or capillary tube.

As used herein the term "turboexpansion" means an expansion employing an expansion device which produces shaft work. Such shaft work is produced by the rotation of a shaft induced by the depressurization of a fluid through one or more fluid conduits connected to the shaft, such as a turbine wheel.

As used herein the term "subambient expansion" means a Joule-Thomson valve expansion or a turboexpansion which produces a lower pressure stream having a temperature lower than ambient.

BRIEF DESCRIPTION OF THE DRAWING

The sole FIGURE is a simplified schematic representation of one preferred embodiment of the liquefied natural gas production method of this invention.

DETAILED DESCRIPTION

The invention is directed to a process employing at least one expansion exhibiting a subambient temperature exhaust (or outlet) which serves to depressurize high-pressure natural gas for subsequent distribution and/or consumption. The invention serves to produce at least a fraction of the feed gas in a condensed liquid state. The subambient exhaust expansion may employ a turbine for the production of work.

In the practice of this invention a high-pressure natural gas stream is extracted from a high-pressure pipeline. A portion of this stream is directed to a first adsorption unit for the removal of water and possibly carbon dioxide. Warming the exhaust/outlet of a sub-ambient expansion generates (at least) a portion of the gas required for regeneration of this first adsorption unit. A second stream of lower flow relative to the first high-pressure stream is obtained directly from the pipeline or from the dehydrated outlet from the first adsorption unit. This stream is directed to a second adsorption unit, which serves to remove carbon dioxide and water. The regeneration gas for the second adsorption unit is obtained from the carbon dioxide free product stream (gas exiting the unit) or from subsequent down stream sub-ambient temperature processing. The regeneration gas exiting the second adsorbent unit is then introduced into either the feed or product stream from the first adsorbent unit. Preferably, this introduction is made possible by either expanding the feed or product of the first stream or by compressing the regeneration gas from second adsorption unit. After prepurification the product of the first adsorption unit is used to generate refrigeration for the cooling and condensation of the product from the second unit.

The invention will be described in greater detail with reference to the Drawing. Referring now to the FIGURE, natural gas passing through natural gas transmission pipeline 100 is at a pressure generally within the range of from 600 to 1500 pounds per square inch absolute (psia). Natural gas stream 101 is taken from pipeline 100 for passage into regional distribution pipeline 180 which is typically operated at a pressure within the range of from 100 to 300 psia. A typical route to supplying this gas may involve a direct depressurization of this gas such as through line 102, valve 200 and heater 201.

In the practice of this invention at least some and preferably a substantial portion of natural gas stream 101 is directed by way of line 103 for the recovery of expansion energy and the production of liquefied natural gas. A portion 11, generally comprising from 60 to 85 percent of stream 103, is passed through valve 110 and passed in stream 12 as a first natural gas stream to first adsorption unit 120 which is preferably a temperature swing adsorption unit but may also be a pressure swing adsorption unit. Adsorption unit 120 will typically employ at least two adsorption beds and a configuration of valves (not shown) in order to facilitate periodic bed switching and regeneration.

Within first adsorption unit 120 the first natural gas stream undergoes water removal resulting in the production of dehydrated natural gas which is withdrawn from first adsorption unit 120 in stream 13. Dehydrated natural gas in stream 13 is cooled to a temperature below the critical temperature of methane (−116.5 F.) by passage through heat exchangers 140 and 150. The resulting cooled dehydrated natural gas 14 is depressurized in a subambient expansion, for example by passage through Joule-Thomson expansion valve 155. Typically the pressure of the natural gas 15 at the exit of valve 155 will be within the range of from 300 to 550 psia. The subambient expansion will result in the production of a two phase mixture.

Two-phase natural gas stream 15 is passed to phase separator vessel 156 wherein it is phase separated for purposes of distribution into a common pass of heat exchanger 150. Liquid from vessel 156 is passed to heat exchanger 150 in stream 16 and vapor from heat exchanger 156 is passed to heat exchanger 150 in stream 17. Within heat exchanger 150 and subsequently in heat exchanger 140, the depressurized natural gas is warmed and completely vaporized by indirect heat exchange with the aforedescribed cooling dehydrated natural gas. The resulting warmed natural gas exits heat exchanger 140 in a substantially superheated state, generally within the range of from 30 to 90 F.

A portion of the warmed depressurized natural gas is used as regeneration gas in first adsorption unit 120. The embodiment of the invention illustrated in the FIGURE is a preferred embodiment wherein the warmed depressurized natural gas undergoes compression and a second subambient expansion prior to recovery and use as a regeneration gas.

Referring back now to the FIGURE, warmed depressurized natural gas 18 is withdrawn from heat exchanger 140 and passed to compressor 160 wherein it is compressed to a pressure generally within the range of from 600 to 900 psia. Resulting compressed natural gas stream 19 is cooled in aftercooler 161, generally to a temperature within the range of from 80 to 100° F. If desired, a portion 20 of the compressed natural gas may be recycled back to stream 13. The remainder of the compressed natural gas is passed to turboexpander 170 wherein it is turboexpanded to a pressure marginally above the final let-down pressure existing in regional distribution pipeline 180. Depending upon feed composition the exit stream 21 of turboexpander 170 may have a marginal amount of entrained condensate. This stream may be directed to a phase separation vessel 147 where the liquid and vapor are separated prior to distribution and warming in heat exchanger 140. After exiting heat exchanger 140 a portion 22 of the turboexpanded gas may be warmed in exchanger 125. The heated gas is used as regeneration gas for adsorption unit 120. The remaining portion 23 may be pressure reduced through valve 126 combined with the exiting regeneration stream from adsorption unit 120 and directed into distribution line 180.

Another portion 24, generally comprising from 15 to 40 percent of stream 103, is passed as a second natural gas stream to second adsorption unit 130, which is preferably a temperature swing adsorption unit but may also be a pressure swing adsorption unit. Carbon dioxide and water are removed from the second natural gas in second adsorption unit 130 to produce clean natural gas which is withdrawn from second adsorption unit 130 in stream 40. A portion 25 of clean natural gas 40, typically from 25 to 75 percent, is warmed by passage through heat exchanger 135 wherein it is heated to a temperature within the range of from 400 to 600° F. and then used as the regeneration gas for second adsorption unit 130. If desired, and as illustrated in the FIGURE, the resulting regeneration gas 26 which exits second adsorption unit 130 may then be passed into stream 12 for processing as was described above. Alternatively, stream 26 may be passed into product stream 13 from the first adsorption unit 120.

The portion 27 of the feed gas subjected to drying and carbon dioxide removal within adsorption system 130 and not used for regeneration is directed to exchanger 140 for cooling. This "liquefaction" stream is cooled to a temperature typically in the range of from −40 to −80 ° F. At this temperature, a small fraction of heavy hydrocarbons may be condensed from this stream 28 and phase separated from the bulk of the stream within phase separation vessel 145. The heavy hydrocarbon condensate stream 29 may be flashed through pressure reducing valve 146 and passed in stream 30 into vessel 147 for subsequent vaporization/warming. The remaining portion 31 of the carbon dioxide free feed stream is further cooled to below the critical temperature of methane within heat exchanger 150. This feed stream exits exchanger 150 in essentially a dense phase/condensed state 32. This pressurized liquefied natural gas stream may be taken directly as product or may be further subcooled by additional indirect heat exchange in heat exchanger 190. This additional subcooling refrigeration (embodied by general process means 195) may be generated by numerous systems including but not limited to direct gas expansion cooling and mixed gas refrigeration. The subcooled pressurized liquefied natural gas stream exiting exchanger 190 may then be depressurized to a pressure marginally above ambient through expansion valve 196. The product liquefied natural gas 33 may be directed to suitable storage or transport (not shown).

Adsorbent systems 120 and 130 may employ a range of adsorbents. Such systems may also be designed to remove trace amounts of hydrogen sulfide from the transmission pipeline gas. It may be possible to use a combination of gases for regeneration. In addition to the use of turboexpansion gas for dehydration regeneration, a small amount of flash gas may be obtained from cold end flashing (valve 196) and storage tank heat ingress. This gas may be used to supplement regeneration gas heating and/or cooling needs. Such gas may be optionally compressed and/or heated prior to use. Although regeneration gas heaters 125 and 135 are shown as indirect heat exchangers it is also possible to use electric heaters or indirect heating from a fired heater or other waste heat source.

An option relative to the operation of the carbon dioxide adsorption system involves the elimination of valve 110. This can be accomplished by including a compressor for purposes of pressurizing the regeneration gas back to the pipeline pressure prior to introduction to system 120. In this way, the refrigeration potential of the feed stream is maximized at some incremental power consumption. An alternative to the use of valve 110 (feed throttling) involves purifying an increased fraction of the feed for carbon dioxide. This increased fraction may be cooled by passage through exchangers 140 and 150 (as shown). At the cold end of exchanger 150, this additional flow of carbon dioxide free gas may be throttled and phase separated like the water free gas directed to valve 155 and separator 156. The resulting stream may then be warmed to ambient and used to regenerate adsorbent system 130. After adsorbing the carbon dioxide, the regeneration gas may then be directed into the carbon dioxide laden circuit. As an example, after warming, the carbon dioxide laden regeneration gas may be directed into the feed stream to compressor 160.

The dehydrated feed refrigeration stream may be optionally phase separated at the exit of exchanger 140 (like that shown for the liquefaction feed). In this case, the heavies condensation may also be directed to vessel 147 and subsequent vaporization within heat exchanger 140.

An important option relative to the regeneration of water removal system 120 involves the use of a gas other than the warmed turboexpansion exhaust gas. For instance, a portion of the moderate pressure vaporized Joule-Thomson expanded stream derived from separator 156 may be used as regeneration gas. In this option, the water laden regeneration gas may then be throttled into the warmed turboexpansion exhaust. This approach is consistent with the essence of this invention in that the regeneration gas for adsorption system 120 is obtained from a subambient expansion. The subject expansion is defined as a turboexpansion (with work production) or subambient Joule-Thomson expansion (or a combination of the two). Although the heavies removed from the liquefaction stream are shown being reintroduced into the let-down stream (turbine exhaust), the heavies stream may be subjected to additional segregation processes for purposes of generating a separate liquefied petroleum gas or butane product stream.

The invention claim is:

1. A method for producing liquefied natural gas comprising:

(A) removing water from a first natural gas stream in a first adsorption unit to produce dehydrated natural gas, cooling the dehydrated natural gas to a temperature below the critical temperature of methane to produce cooled dehydrated natural gas, expanding the cooled dehydrated natural gas in a subambient expansion to produce depressurized natural gas, warming the depressurized natural gas, and using a portion of the warmed depressurized natural gas as regeneration gas in the first adsorption unit; and (B) removing carbon dioxide and water from a second natural gas stream in a second adsorption unit to produce clean natural gas, liquefying a portion of the clean natural gas to produce liquefied natural gas, and using another portion of the clean natural gas as regeneration gas in the second adsorption unit wherein the depressurized natural gas for use as regeneration gas for the first adsorption unit is generated by a subambient Joule-Thomson valve expansion, a subsequent compression, and then a subambient turboexpansion.

2. The method of claim 1 further comprising removing carbon dioxide from the first natural gas stream in the first adsorption unit.

3. The method of claim 1 wherein the warming of the depressurized natural gas is by indirect heat exchange with the cooling dehydrated natural gas.

4. The method of claim 1 wherein the warming of the dehydrated natural gas is by indirect heat exchange with the liquefying clean natural gas.

5. The method of claim 1 wherein the liquefied natural gas is subcooled.

6. The method of claim 1 wherein the warmed depressurized natural gas is recovered as product.

7. The method of claim 1 wherein the clean natural gas which is used as the regeneration gas in the second adsorption unit is then passed to the first adsorption unit.

8. The method of claim 1 wherein the clean natural gas which is used as the regeneration gas in the second adsorption unit is then combined with the dehydrated natural gas.

9. The method of claim 1 wherein both the first adsorption unit and the second adsorption unit are temperature swing adsorption units.

10. The method of claim 1 wherein the subambient expansion is a Joule-Thomson valve expansion.

11. The method of claim 1 wherein the subambient expansion is a turboexpansion.

* * * * *